US010987950B2

(12) United States Patent
Miyakoshi

(10) Patent No.: US 10,987,950 B2
(45) Date of Patent: Apr. 27, 2021

(54) CURL STRAIGHTENING DEVICE AND IMAGE FORMING APPARATUS HAVING THE SAME

(71) Applicant: KYOCERA Document Solutions Inc., Osaka (JP)

(72) Inventor: Naoto Miyakoshi, Osaka (JP)

(73) Assignee: KYOCERA Document Solutions Inc.

( * ) Notice: Subject to any disclaimer, the term of this patent is extended or adjusted under 35 U.S.C. 154(b) by 0 days.

(21) Appl. No.: 16/377,298

(22) Filed: Apr. 8, 2019

(65) Prior Publication Data

US 2019/0315133 A1 Oct. 17, 2019

(30) Foreign Application Priority Data

Apr. 13, 2018 (JP) ..... JP2018-077646

(51) Int. Cl.
*B41J 11/00* (2006.01)
*B65H 29/52* (2006.01)
*B41J 13/076* (2006.01)

(52) U.S. Cl.
CPC ..... *B41J 11/0005* (2013.01); *B41J 11/007* (2013.01); *B41J 11/0045* (2013.01); *B41J 13/076* (2013.01); *B65H 29/52* (2013.01); *B65H 2301/51256* (2013.01); *B65H 2404/1521* (2013.01); *B65H 2404/262* (2013.01)

(58) Field of Classification Search
CPC .... B41J 11/0005; B41J 13/076; B41J 11/007; B41J 11/0045; B41J 13/025; B41J 2/21; B65H 29/52; B65H 2404/1521; B65H 2404/262; B65H 2301/51256; B65H 2404/2693; B65H 2801/27; B65H 29/70; B65H 2701/19
See application file for complete search history.

(56) References Cited

U.S. PATENT DOCUMENTS 5,287,157 A 2/1994 Miyazato et al.
5,392,106 A * 2/1995 Bigenwald ..... B65H 29/12 162/270

(Continued)

FOREIGN PATENT DOCUMENTS

JP 4-338060 11/1992

*Primary Examiner* — Justin Seo
(74) *Attorney, Agent, or Firm* — Gerald E. Hespos; Michael J. Porco; Matthew T. Hespos

(57) ABSTRACT

The curl straightening device includes supporting rollers, an endless belt, a curl straightening roller, and a contact member. The supporting rollers are disposed rotatably about a shaft extending in a direction orthogonal to a conveying direction of the sheet. The endless belt is stretched across the supporting rollers, and circulates in the conveying direction. The curl straightening roller makes contact with an outer peripheral surface of the endless belt between the supporting rollers so as to form a nip portion, and straightens curl of the sheet which passes through the nip portion. The nip portion is shaped so that the endless belt curves along a peripheral surface of the curl straightening roller. The contact member is disposed to oppose a center portion of the curl straightening roller in an axial direction, and makes contact with the curl straightening roller so as to prevent deformation of the curl straightening roller.

8 Claims, 7 Drawing Sheets

(56) References Cited

U.S. PATENT DOCUMENTS

| | | | | |
|---|---|---|---|---|
| 5,555,083 | A * | 9/1996 | Kuo | B65H 5/025 162/197 |
| 2015/0008636 | A1* | 1/2015 | Tsuda | B41J 11/0005 271/3.2 |
| 2016/0355029 | A1* | 12/2016 | Kondo | B41J 2/01 |

* cited by examiner

CURL STRAIGHTENING DEVICE AND IMAGE FORMING APPARATUS HAVING THE SAME

INCORPORATION BY REFERENCE

This application contains subject matter related to Japanese Patent Application No. 2018-77646 filed in Japanese Patent Office on Apr. 13, 2018, the entire content of which being incorporated herein by reference.

BACKGROUND

The present disclosure relates to a curl straightening device that straightens curl of a sheet on which an image has been formed, and an image forming apparatus having the curl straightening device.

A publicly-known image forming apparatus such as a printer includes a curl straightening device that straightens curl of a sheet on which an image has been formed. Such a conventional curl straightening device includes an endless belt stretched across a pair of supporting rollers, and a curl straightening roller (a pressurizing roller) that makes pressure contacts with an outer peripheral surface of the endless belt. In the curl straightening device, the pressure contact of the curl straightening roller straightens curl of a sheet when the sheet passes through a nip portion formed in the endless belt.

SUMMARY

One aspect of the present disclosure provides a curl straightening device that straightens curl of a sheet to be conveyed. The curl straightening device includes supporting rollers, an endless belt, a curl straightening roller, and a contact member. The supporting rollers are disposed rotatably about a shaft extending in a direction orthogonal to a conveying direction of the sheet. The endless belt is stretched across the supporting rollers, and circulates in the conveying direction. The curl straightening roller makes contact with an outer peripheral surface of the endless belt between the supporting rollers so as to form a nip portion, and straightens curl of the sheet which passes through the nip portion. The nip portion is shaped so that the endless belt curves along a peripheral surface of the curl straightening roller. The contact member is disposed to oppose a center portion of the curl straightening roller in an axial direction, and makes contact with the curl straightening roller so as to prevent deformation of the curl straightening roller.

Another aspect of the present disclosure provides an image forming apparatus including an image forming unit that forms an image on a sheet, and the curl straightening device that straightens curl of the sheet where an image has been formed by the image forming unit.

DETAILED DESCRIPTION

A curl straightening device and an image forming apparatus according to an embodiment of the present disclosure will be described below with reference to the drawings. The following description refers to a front-rear direction, a right-left direction, and an up-down direction, but these directions are used for convenience of the description and thus not intended to limit the present disclosure. In the following description, a term "sheet" means plain paper, a card board, a postcard, tracing paper, and the other sheet materials subject to an image forming process.

[Entire Configuration of Image Forming Apparatus]

Figure 1:
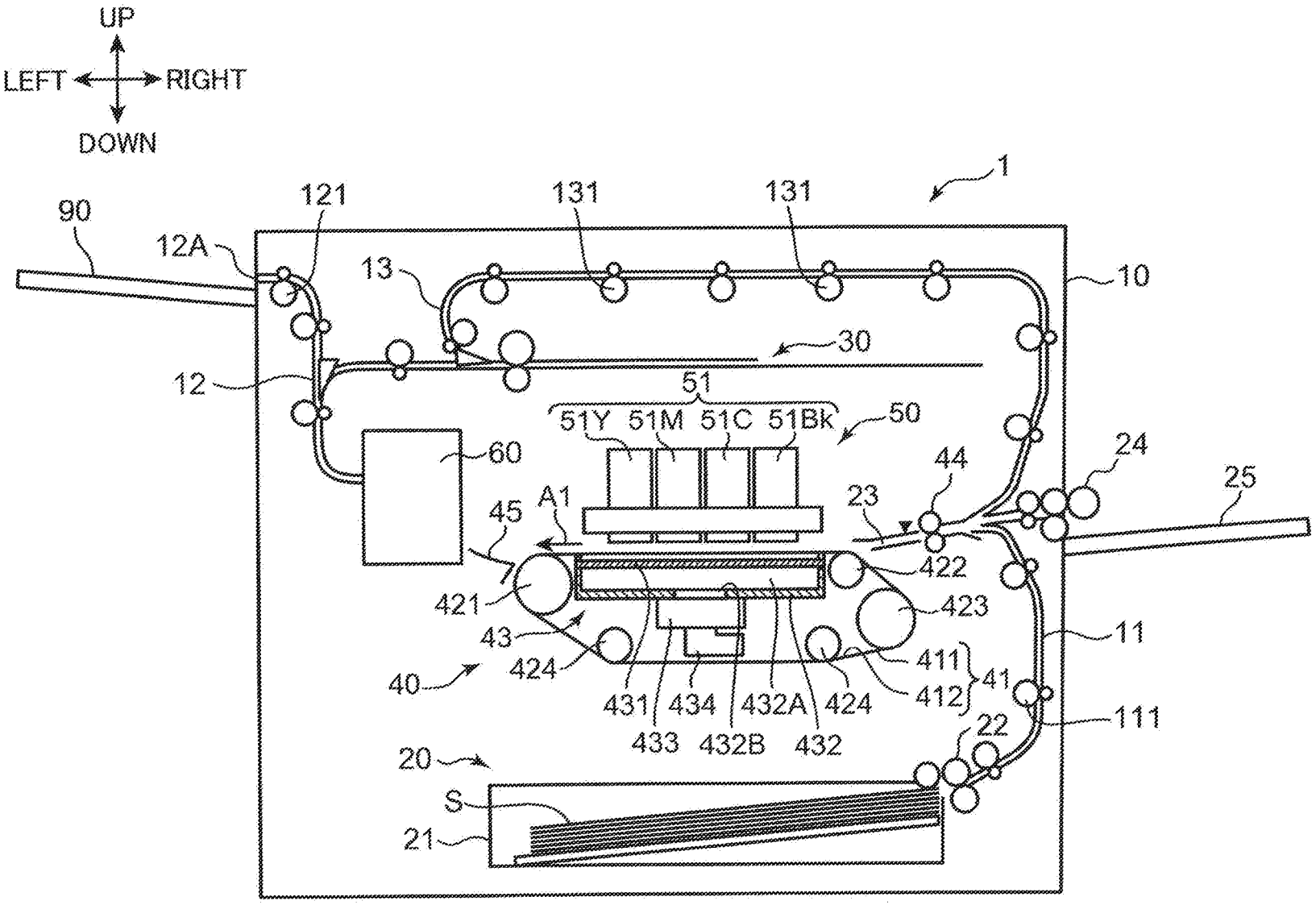
FIG. 1 is a diagram illustrating an internal structure of an image forming apparatus according to an embodiment of the present disclosure.

FIG. 1 is a diagram illustrating an internal structure of an image forming apparatus 1 according to the embodiment of the present disclosure. The image forming apparatus 1 illustrated in FIG. 1 is an ink jet recording apparatus that ejects ink droplets to form (record) an image on a sheet S. The image forming apparatus 1 includes an apparatus main body 10, a paper feed unit 20, a sheet inverting unit 30, a sheet conveyance unit 40, an image forming unit 50, and a curl straightening device 60.

The apparatus main body 10 is a box-shaped case for housing various devices that form an image on the sheet S. The apparatus main body 10 includes a first conveyance path 11, a second conveyance path 12, and a third conveyance path 13 which are to be conveyance paths of the sheet S.

The paper feed unit 20 feeds the sheet S to the first conveyance path 11. The paper feed unit 20 includes a paper feed cassette 21 and a pickup roller 22. The paper feed cassette 21 is detachable from the apparatus main body 10 and stores sheets S. The pickup roller 22 is disposed at an upper right end side of the paper feed cassette 21. The pickup roller 22 feeds every top one of the sheets S stored in the paper feed cassette 21 successively one by one to send the sheet S to the first conveyance path 11.

The sheet S fed to the first conveyance path 11 is conveyed to a register roller pair 44 of the sheet conveyance unit 40 disposed on a downstream end of the first conveyance path 11 by a first conveyance roller pair 111 disposed on the first conveyance path 11. Further, a paper feed tray 25 is disposed on a right side of the apparatus main body 10, and sheet S can be placed on an upper surface of the paper feed tray 25. The sheet S placed on the paper feed tray 25 is fed toward the register roller pair 44 by the paper feed roller 24.

The register roller pair 44 is a conveyance roller pair that is disposed on an upstream end in the sheet conveyance unit 40. The register roller pair 44 straightens skew of the sheet S, and sends the sheet S toward a conveyance belt 41 via a sheet introduction guide member 23 in accordance with the timing of the execution of an image forming process by the image forming unit 50. The sheet introduction guide member 23 guides the sheet S sent by the register roller pair 44 toward an outer peripheral surface 411 of the conveyance belt 41.

When a forward end of the sheet S guided by the sheet introduction guide member 23 makes contact with the outer peripheral surface 411 of the conveyance belt 41, drive of the conveyance belt 41 conveys the sheet S, held on the outer peripheral surface 411, toward a sheet conveying direction A1. Note that the sheet conveying direction A1 is a direction of movement from right to left in the right-left direction.

The sheet conveyance unit 40 is disposed below the image forming unit 50 so as to oppose a line head 51. The sheet conveyance unit 40 conveys the sheet S guided and introduced by the sheet introduction guide member 23 toward the sheet conveying direction A1 so that the sheet S passes below the image forming unit 50. The sheet conveyance unit 40 includes the conveyance belt 41 and a suction unit 43 as well as the register roller pair 44.

The conveyance belt 41 is an endless belt which has a width in the front-rear direction and extends in the right-left direction. The conveyance belt 41 is disposed to oppose the image forming unit 50 and conveys the sheet S on the outer peripheral surface 411 toward the sheet conveying direction A1. More specifically, the conveyance belt 41 holds the sheet S on the outer peripheral surface 411 within a predetermined conveyance region opposing the line head 51 of the image forming unit 50 and conveys the sheet S toward the sheet conveying direction A1.

The conveyance belt 41 is stretched across a first roller 421, a second roller 422, a third roller 423, and a pair of fourth rollers 424. The suction unit 43 is disposed inside the stretched conveyance belt 41 so as to oppose the inner peripheral surface 412. The first roller 421 is a drive roller that extends along the front-rear direction to be a width direction of the conveyance belt 41, and is disposed downstream of the suction unit 43 in the sheet conveying direction A1. The first roller 421 is driven to rotate by a drive motor, unillustrated, so as to circulate the conveyance belt 41 in a predetermined circulation direction. The circulation of the conveyance belt 41 conveys sheet S held on the outer peripheral surface 411 toward the sheet conveying direction A1.

The second roller 422 is a belt speed detection roller that extends along the front-rear direction and is disposed upstream of the suction unit 43 in the sheet conveying direction A1. The second roller 422 is disposed to be cooperative with the first roller 421 and to achieve flatness between a region, opposing the line head 51, on the outer peripheral surface 411 of the conveyance belt 41 and a region, opposing the suction unit 43, on the inner peripheral surface 412 of the conveyance belt 41. Herein, on the outer peripheral surface 411 of the conveyance belt 41, a region that opposes the line head 51 between the first roller 421 and the second roller 422 is the predetermined conveyance region where the sheet S is held and conveyed. The second roller 422 is driven to rotate in conjunction with the circulation of the conveyance belt 41. A pulse plate, unillustrated, which is mounted to the second roller 422, rotates integrally with the second roller 422. A rotational speed of the conveyance belt 41 is detected by measuring a rotational speed of the pulse plate.

The third roller 423, which is a tension roller extending along the front-rear direction, applies a tension to the conveyance belt 41 so as to prevent the conveyance belt 41 from being loosen. The third roller 423 is driven to rotate in conjunction with the circulation of the conveyance belt 41. The pair of fourth rollers 424, which is a pair of guide rollers extending along the front-rear direction, guides the conveyance belt 41 so that the conveyance belt 41 passes below the suction unit 43. The pair of fourth rollers 424 is driven to rotate in conjunction with the circulation of the conveyance belt 41.

Further, the conveyance belt 41 has a plurality of suction holes which pierces from the outer peripheral surface 411 to the inner peripheral surface 412 in a thickness direction.

The suction unit 43 is disposed to oppose the image forming unit 50 via the conveyance belt 41. As for more details, the suction unit 43 is disposed to oppose the inner peripheral surface 412 inside the conveyance belt 41 stretched across the first to fourth rollers 421 to 424. The suction unit 43 generates a negative pressure between the sheet S held on the outer peripheral surface 411 of the conveyance belt 41 and the conveyance belt 41 so as to allow the sheet S to make close contact with the outer peripheral surface 411 of the conveyance belt 41. The suction unit 43 includes a belt guide member 431, a suction case 432, a suction device 433, and an exhaust air duct 434.

The belt guide member 431, which is a plate member having an approximately identical width with a length in the width direction (the front-rear direction) of the conveyance belt 41, is disposed to oppose a region between the first roller 421 and the second roller 422 on the inner peripheral surface 412 of the conveyance belt 41. The belt guide member 431 configures an upper surface of the suction case 432, and has an approximately identical shape with the suction case 432 when viewed from the top. The belt guide member 431 guides the circulation of the conveyance belt 41 between the first roller 421 and the second roller 422 in conjunction with the rotation of the first roller 421.

Further, the belt guide member 431 has a plurality of groove portions formed on a belt guide surface opposing the inner peripheral surface 412 of the conveyance belt 41. Each of the groove portions is formed correspondingly to a corresponding one of the suction holes on the conveyance belt 41. Further, the belt guide member 431 has through holes corresponding to the groove portions, respectively. The through holes, which pierce the belt guide member 431 in a thickness direction in the groove portions, are communicated with the suction holes on the conveyance belt 41 via the groove portions, respectively.

The suction unit 43, which has the above configuration and includes the belt guide member 431, sucks air from a space above the conveyance belt 41 via the groove portions and the through holes of the belt guide member 431 and via the suction holes of the conveyance belt 41 so as to generate a suction force. This suction force generates an air flow (suction wind) toward the suction unit 43 in the space above the conveyance belt 41. The sheet S is guided onto the conveyance belt 41 by the sheet introduction guide member 23 so as to partially cover the outer peripheral surface 411 of the conveyance belt 41. The sheet S is then affected by the suction force (the negative pressure) so as to make close contact with the outer peripheral surface 411 of the conveyance belt 41.

The suction case 432, which is a box-shaped case having a top opening, is disposed below the conveyance belt 41 so that the top opening is covered by the belt guide member 431 structuring the upper surface of the suction case 432. The suction case 432 defines a suction space 432A together with the belt guide member 431 structuring the upper surface of the suction case 432. That is, a space surrounded by the suction case 432 and the belt guide member 431 is the suction space 432A. The suction space 432A is communicated with the suction holes of the conveyance belt 41 via the groove portions and the through holes of the belt guide member 431.

A bottom wall of the suction case 432 has the opening 432B, and the suction device 433 is disposed correspondingly to the opening 432B. The suction device 433 is connected with the exhaust air duct 434. The exhaust air duct 434 is communicated with an exhaust port, unillustrated, disposed in the apparatus main body 10.

The image forming unit 50 is disposed above the sheet conveyance unit 40. Specifically, the image forming unit 50 is disposed above the sheet conveyance unit 40 so as to oppose the outer peripheral surface 411 of the conveyance belt 41. The image forming unit 50 executes an image forming process on the sheet S which is held on the outer peripheral surface 411 of the conveyance belt 41 and conveyed toward the sheet conveying direction A1 so as to form an image on the sheet S. In the embodiment, the image forming unit 50, which adopts an ink-jet image forming method, ejects ink droplets so as to form an image on the sheet S.

The image forming unit 50 includes line heads 51Bk, 51C, 51M, and 51Y. The line head 51Bk ejects black ink droplets, the line head 51C ejects cyan ink droplets, the line head 51M ejects magenta ink droplets, and the line head 51Y ejects yellow ink droplets. The line heads 51Bk, 51C, 51M, and 51Y are disposed in parallel from an upstream side toward a downstream side in the sheet conveying direction A1. Since the line heads 51Bk, 51C, 51M, and 51Y have an identical configuration except for different-color ink droplets to be ejected, they may collectively be referred to as the line head 51.

The line head 51 ejects ink droplets onto the sheet S, which is held on the outer peripheral surface 411 of the conveyance belt 41 and conveyed toward the sheet conveying direction A1, so as to form an image on the sheet S. As for more details, the line head 51 ejects ink droplets to the sheet S which is conveyed by the conveyance belt 41 and passes through a position opposing the line head 51. The ejecting the ink droplets forms an image on the sheet S.

The sheet S where the line head 51 has ejected the ink droplets and the image has been formed is conveyed by the conveyance belt 41, and is sent toward the curl straightening device 60 while being guided by a sheet sending guide portion 45. The curl straightening device 60 is disposed on a downstream side in the sheet conveying direction A1 of the conveyance belt 41 across the sheet sending guide portion 45. The curl straightening device 60 transports the sheet S on which the image has been formed toward the downstream side and simultaneously straightens curl of the sheet S. Details of the curl straightening device 60 will be described later.

The sheet S whose curl has been straightened by the curl straightening device 60 is sent to the second conveyance path 12. The second conveyance path 12 extends along the left side surface of the apparatus main body 10. The sheet S sent to the second conveyance path 12 is conveyed by a second conveyance roller pair 121, which is disposed on the second conveyance path 12, toward the paper discharge port 12A formed on the left side of the apparatus main body 10, and is discharged onto a paper discharge portion 90 through the paper discharge port 12A.

On the other hand, when the sheet S sent toward the second conveyance path 12 is a double side printing sheet whose front surface has been subject to the image forming process, the sheet S is sent to the sheet inverting unit 30. The sheet inverting unit 30 is a conveyance path branched from the second conveyance path 12, and the sheet S is inverted (turned over) on that path. The turned-back sheet S is sent to the third conveyance path 13. The sheet S sent to the third conveyance path 13 is sent back by a third conveyance roller pair 131 disposed on the third conveyance path 13, and the sheet S, which has been turned back, is supplied again onto the outer peripheral surface 411 of the conveyance belt 41 via the register roller pair 44 and the sheet introduction guide member 23. While the sheet S supplied onto the outer peripheral surface 411 is being conveyed by the conveyance belt 41, the rear surface of the sheet S is subject to the image forming process by the image forming unit 50. The sheet S that has been subject to double-side printing passes through the second conveyance path 12 so as to be discharged onto the paper discharge portion 90 through the paper discharge port 12A.

The image forming apparatus 1 of ink-jet type uses aqueous ink containing fluid more and more frequently. The sheet S made of paper absorbs water, hydrogen bonding of cellulose composing the sheet S is separated, and the sheet S expands. The sheet S thus curls (curves) so that an ink impacting surface (an image formed surface) rises. Therefore, the image forming apparatus 1 includes the curl straightening device 60 that straightens curl of the sheet S.

[Configuration of Curl Straightening Device]

Figure 2:
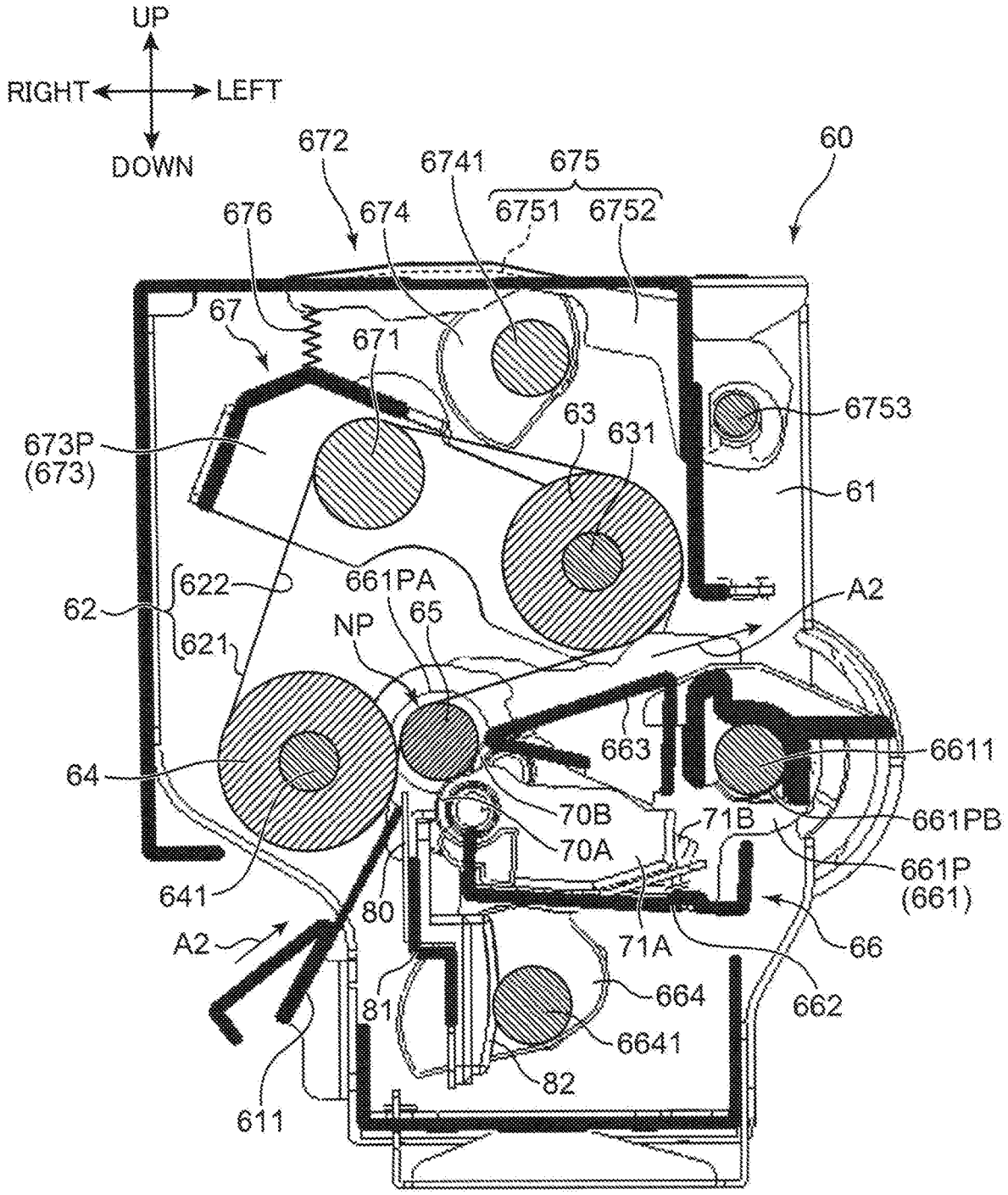
FIG. 2 is a cross-sectional view of a curl straightening device included in the image forming apparatus.
Figure 3:
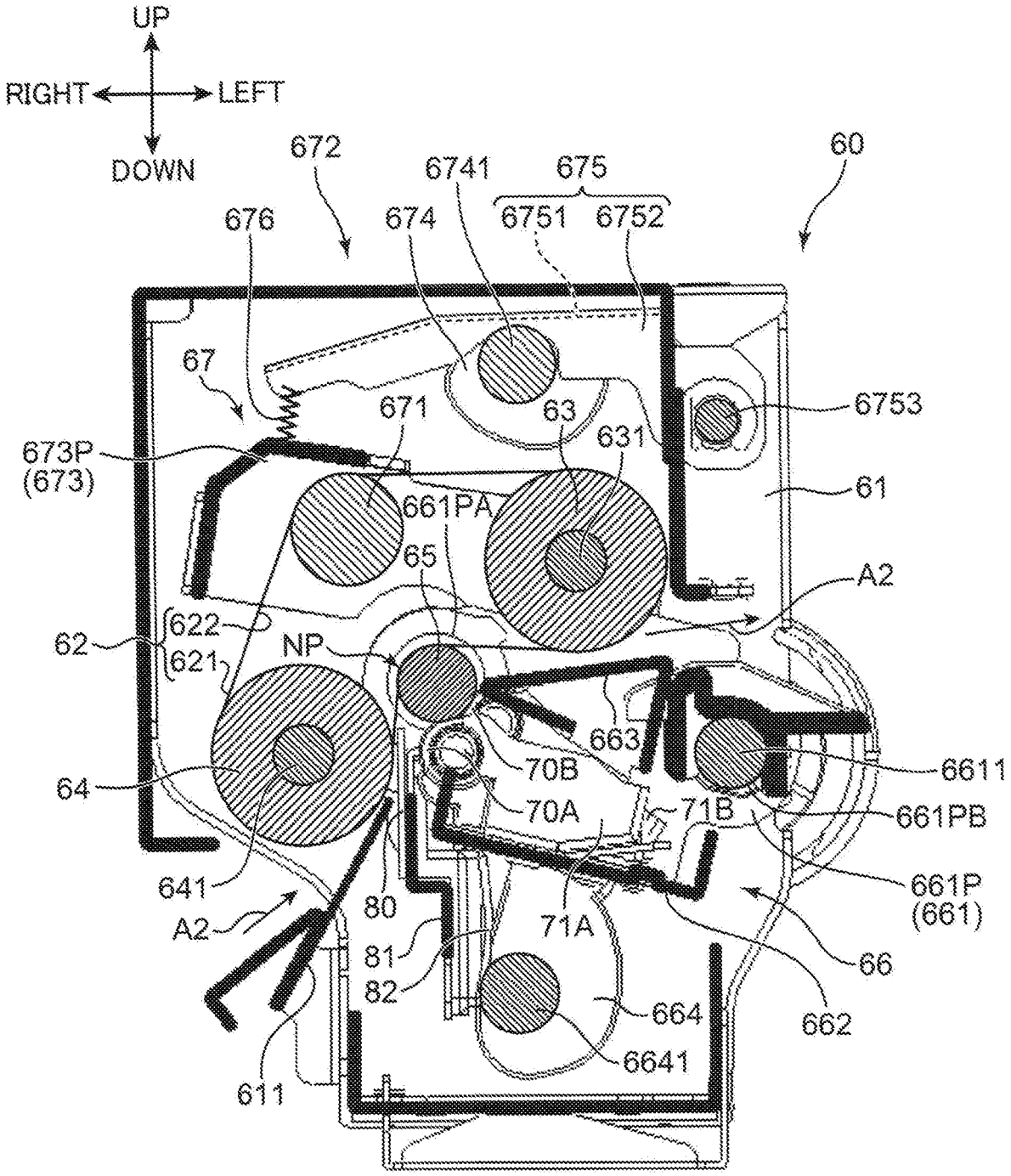
FIG. 3 is a cross-sectional view of the curl straightening device.
Figure 4:
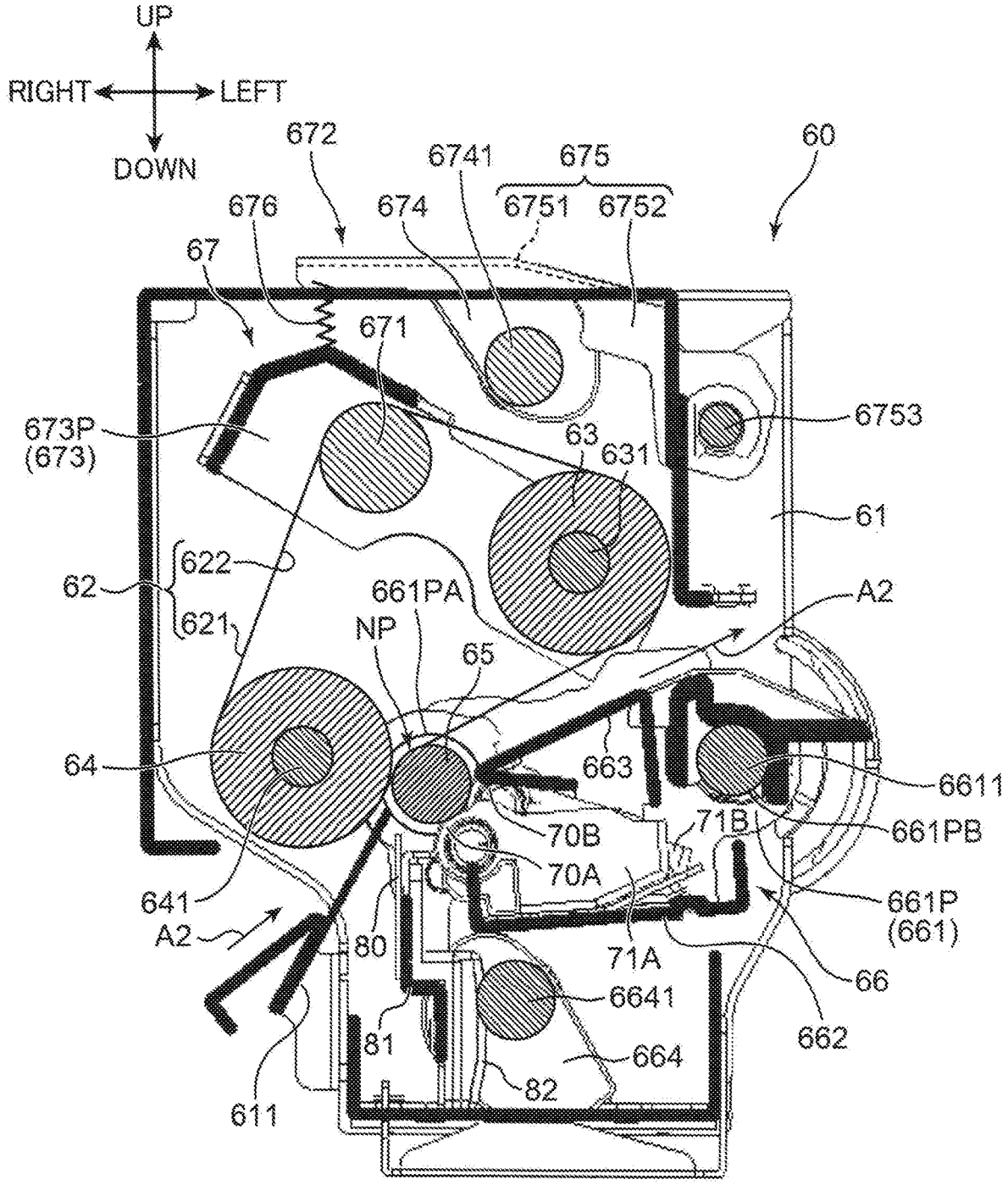
FIG. 4 is a cross-sectional view of the curl straightening device.

FIGS. 2 to 4 are cross-sectional views of the curl straightening device 60 mounted on the image forming apparatus 1. The curl straightening device 60 includes a main body frame 61, an endless belt 62, a curl straightening roller 65, a nip width adjusting mechanism 66, a belt tension adjusting mechanism 67, contact members 70A and 70B, and a guide member 80.

The main body frame 61 is a frame for supporting various members structuring the curl straightening device 60, and is fixed between the sheet sending guide portion 45 and the second conveyance path 12 in the apparatus main body 10. Further, the main body frame 61 has a lower right end on which a sheet guide piece 611 is disposed. The sheet S sent from the conveyance belt 41 while being guided by the sheet sending guide portion 45 is received by the curl straightening device 60 through the sheet guide piece 611. The sheet guide piece 611 guides the sheet S toward the endless belt 62.

<Endless Belt>

The endless belt 62 has a width in the front-rear direction. The endless belt 62 is stretched across a first supporting roller 63 and a second supporting roller 64 that are the pair of supporting rollers. The first supporting roller 63 is a drive roller that extends along the front-rear direction to be a width direction of the endless belt 62 and is supported to the main body frame 61. The first supporting roller 63 is driven to rotate about a rotary shaft 631 by the drive motor, unillustrated, so as to cause the endless belt 62 to circulate. The circulation of the endless belt 62 conveys the sheet S along an outer peripheral surface 621 in a sheet conveying direction A2. The second supporting roller 64 is a driven roller which extends along the front-rear direction and is supported rotatably to the main body frame 61. The second supporting roller 64 is driven to rotate about a rotary shaft 641 in conjunction with the circulation of the endless belt 62. The second supporting roller 64 is disposed on an obliquely lower right side relative to the first supporting roller 63 so as to be close to the sheet guide piece 611.

A region, which opposes the curl straightening roller 65, described later, on the outer peripheral surface 621 of the endless belt 62 and is between the first supporting roller 63 and the second supporting roller 64, is a conveyance region in which the sheet S is conveyed. That is, the first supporting roller 63 defines a downstream end of the sheet conveying direction A2 in the curl straightening device 60, and the second supporting roller 64 defines an upstream end of the sheet conveying direction A2 in the curl straightening device 60.

<Curl Straightening Roller>

The curl straightening roller 65 extends along the front-rear direction, and is supported rotatably to a first roller supporting holder 661 in the nip width adjusting mechanism 66, described later. The curl straightening roller 65 makes pressure contact with the outer peripheral surface 621 of the endless belt 62 between the first supporting roller 63 and the second supporting roller 64, and is driven to rotate in conjunction with the circulation of the endless belt 62. The endless belt 62 forms a nip portion NP where the sheet S passes between the endless belt 62 and the curl straightening roller 65. The nip portion NP has a curved shape along an outer peripheral surface of the curl straightening roller 65. In other words, the curved nip portion NP has a radius of curvature that is equal to a radius of the curl straightening roller 65. While being conveyed in the sheet conveying direction A2 by the endless belt 62 which circulates, the sheet S, on which an image has been formed, passes through the curved nip portion NP, and thus the curl is straightened.

<Nip Width Adjusting Mechanism>

The nip width adjusting mechanism 66 moves the curl straightening roller 65 in a direction away from or close to the endless belt 62, namely, in a direction crossing an axial direction (the front-rear direction) of the curl straightening roller 65, thus changing a nip width in the nip portion NP. The nip width in the nip portion NP is a width orthogonal to the axial direction of the curl straightening roller 65 in a passing direction of the sheet S (the sheet conveying direction A2), and a width along the peripheral direction of the outer peripheral surface of the curl straightening roller 65.

The nip width adjusting mechanism 66 moves the curl straightening roller 65 so that the nip width in the nip portion NP changes among a first nip width as a reference, a second nip width wider than the first nip width, and a third nip width narrower than the first nip width. FIG. 2 illustrates a state in which the curl straightening roller 65 is moved so that the nip width in the nip portion NP is the first nip width as the reference. Further, FIG. 3 illustrates a state in which the curl straightening roller 65 is moved so that the nip width in the nip portion NP is the second nip width. Further, FIG. 4 illustrates a state in which the curl straightening roller 65 is moved so that the nip width in the nip portion NP is the third nip width. In the curl straightening device 60, the nip width adjusting mechanism 66 is configured to change the nip width in the nip portion NP, and thus can change a curl straightening force for the sheet S which passes through the nip portion NP.

The curl straightening force for the sheet S which passes through the nip portion NP is stronger in the nip portion NP with wider nip width. That is, the curl straightening force for the sheet S which passes through the nip portion NP is stronger in the state in which the nip width adjusting mechanism 66 moves the curl straightening roller 65 so that the nip width in the nip portion NP is the second nip width (the state illustrated in FIG. 3) than in the state of the first nip width as the reference (the state illustrated in FIG. 2). On the other hand, the curl straightening force for the sheet S which passes through the nip portion NP is weaker in the state in which the nip width adjusting mechanism 66 moves the curl straightening roller 65 so that the nip width in the nip portion NP is the third nip width (the state illustrated in FIG. 4) than in the state of the first nip width as the reference (the state illustrated in FIG. 2).

Herein, a curl amount (curvature) of curl caused on the sheet S where an image has been formed depends on an area ratio of the image formed on the sheet S. A higher image area ratio makes the curl amount of the sheet S bigger. Further, the curl amount of the sheet S depends on a sheet thickness. A bigger sheet thickness makes the curl amount of the sheet S smaller. A curl amount of a second sheet (a card board) thicker than a first sheet (plain paper) having a reference sheet thickness is hardly affected by the image area ratio. On the other hand, the curl amount of the first sheet (plain paper) is easily affected by the image area ratio.

For example, in a case of the first sheet (plain paper) with a predetermined image area ratio or lower in which a standard amount of curl occurs, the nip width in the nip portion NP is set to the first nip width as the reference (FIG. 2). In a case of the first sheet (plain paper) with an image area ratio exceeding the predetermined image area ratio in which curl larger in amount than the standard curl occurs, the nip width in the nip portion NP may be set to the second nip width wider than the first nip width as the reference (FIG. 3). Such a setting of the nip width in the nip portion NP can apply a stronger curl straightening force to a sheet with a large curl amount when the sheet passes through the nip portion NP. The curl that occurs on the sheet when the image is formed thereon can be thus straightened appropriately.

On the other hand, in a case of the second sheet (card board) in which curl smaller in amount than the standard curl occurs, the nip width in the nip portion NP may be set to the third nip width narrower than the first nip width as the reference (FIG. 4). Such a setting of the nip width in the nip portion NP can apply a weaker curl straightening force to a sheet, with a smaller curl amount, in which application of an appropriate curl straightening force easily causes curl in an opposite direction to at the time of forming an image, when the sheet passes through the nip portion NP. The curl that occurs on the sheet when the image is formed thereon can be thus straightened appropriately.

A specific configuration of the nip width adjusting mechanism 66 will be described below. The nip width adjusting mechanism 66 includes the first roller supporting holder 661 that supports the curl straightening roller 65 rotatably, and a nip width adjusting cam 664.

The first roller supporting holder 661 includes a pair of first supporting plates 661P disposed to oppose each other with a clearance therebetween in the width direction (the front-rear direction), and a bottom plate 662 disposed between the pair of first supporting plates 661P. The pair of first supporting plates 661P includes a bearing 661PA that pivotally supports the curl straightening roller 65 such that the curl straightening roller 65 is rotatable. FIGS. 2 to 4 illustrate only one of the pair of first supporting plates 661P and do not illustrate the other first supporting plate. The first roller supporting holder 661 is supported to the main body frame 61 so as to be rotationally movable about a rotationally moving shaft 6611 that is inserted through a through hole 661PB of the pair of first supporting plates 661P.

The bottom plate 662 is disposed between the pair of first supporting plates 661P and is formed into a plate shape extending along the axial direction of the curl straightening roller 65. The bottom plate 662 is disposed between the pair of first supporting plates 661P over an entire area of the width direction (the front-rear direction), and is connected to lower ends of the pair of first supporting plates 661P. The bottom plate 662 is a portion with which the nip width adjusting cam 664 makes contact in the first roller supporting holder 661. The nip width adjusting cam 664 makes contact with both ends of the bottom plate 662 in the width direction.

Further, a sheet guide 663 is disposed between the pair of first supporting plates 661P over the entire area in the width direction. The sheet guide 663 is disposed to oppose the first supporting roller 63 via the endless belt 62. The sheet guide 663 guides conveyance of the sheet S that has passed through the nip portion NP, the conveyance being caused by the circulation of the endless belt 62.

The nip width adjusting cam 664 is a cam member that rotates about a cam rotary shaft 6641 extending along the curl straightening roller 65 in a position below the bottom plate 662 while making contact with the bottom plate 662. In the embodiment, the nip width adjusting cam 664 is fixed to both ends of the cam rotary shaft 6641. The cam rotary shaft 6641 is supported rotatably to the main body frame 61. The nip width adjusting cam 664 configures a rotationally moving portion that rotationally moves the first roller supporting holder 661 about the rotationally moving shaft 6611 so that the curl straightening roller 65 moves in the direction away from or close to the endless belt 62.

In the nip width adjusting mechanism 66, the first roller supporting holder 661 rotationally moves about the rotationally moving shaft 6611 in conjunction with the rotation of the nip width adjusting cam 664. The rotational movement of the first roller supporting holder 661 moves the curl straightening roller 65 supported to the first roller supporting holder 661 with respect to the endless belt 62. Accordingly, the nip width in the nip portion NP changes. Note that a movement locus of the curl straightening roller 65 in accordance with the rotational movement of the first roller supporting holder 661 about the rotationally moving shaft 6611 has an arc shape in which the rotationally moving shaft 6611 is a center.

<Belt Tension Adjusting Mechanism>

The belt tension adjusting mechanism 67 changes tension of the endless belt 62 in response to a change in the nip width caused by the nip width adjusting mechanism 66. Such a change in the tension of the endless belt 62 keeps the conveyance force to be applied to the sheet S when the sheet S passes through the nip portion NP constant in response to the change in the nip width. The constant conveyance force can achieve suitable conveyance of the sheet S which passes through the nip portion NP.

In the embodiment, the belt tension adjusting mechanism 67 reduces the tension of the endless belt 62 proportionally with the nip width in the nip portion NP. As for more details, the belt tension adjusting mechanism 67 changes the tension of the endless belt 62 so that second tension associated with the state in which the nip width adjusting mechanism 66 sets the nip width in the nip portion NP to the second nip width wider than the first nip width (the state illustrated in FIG. 3) is smaller than first tension associated with the state in which the nip width in the nip portion NP is the first nip width as the reference (the state illustrated in FIG. 2). Further, the belt tension adjusting mechanism 67 changes the tension of the endless belt 62 so that third tension associated with the state in which the nip width adjusting mechanism 66 sets the nip width in the nip portion NP to the third nip width narrower than the first nip width (the state illustrated in FIG. 4) is larger than the first tension associated with the state in which the nip width in the nip portion NP is the first nip width as the reference (the state illustrated in FIG. 2). As a result, the conveyance force to be applied to the sheet S when the sheet S passes through the nip portion NP is kept constant so as to be equal in response to the change in the nip width among the first nip width, the second nip width, and the third nip width. This constant conveyance force achieves appropriate conveyance of the sheet S which passes through the nip portion NP and can change the curl straightening force for the sheet S in response to the change in the nip width.

A specific configuration of the belt tension adjusting mechanism 67 according to the present embodiment will be described below. The belt tension adjusting mechanism 67 includes a tension roller 671 and a roller moving mechanism 672.

The tension roller 671 is disposed on an inner peripheral surface 622 of the endless belt 62, and applies a tension to the endless belt 62 while supporting the endless belt 62 in a circularly movable manner. The tension roller 671 extends along the front-rear direction and is supported rotatably to the second roller supporting holder 673 in the roller moving mechanism 672, described later. The tension roller 671 is driven to rotate in conjunction with the circulation of the endless belt 62.

The roller moving mechanism 672 moves the tension roller 671 in a direction crossing an axial direction (the front-rear direction) of the tension roller 671 so as to change the tension of the endless belt 62. The roller moving mechanism 672 moves the tension roller 671 without changing positions of the first supporting roller 63 and the second supporting roller 64 that support the endless belt 62. As described above, the first supporting roller 63 defines the downstream end of the sheet conveying direction A2 in the curl straightening device 60, and the second supporting roller 64 defines the upstream end of the sheet conveying direction A2 in the curl straightening device 60. The roller moving mechanism 672 does not change the positions of the first supporting roller 63 and the second supporting roller 64 when moving the tension roller 671. This can locate the upstream end and the downstream end of the sheet conveying direction A2 in the curl straightening device 60 stationarily.

A specific configuration of the roller moving mechanism 672 will be described below. The roller moving mechanism 672 includes a second roller supporting holder 673 that supports the tension roller 671, a belt tension adjusting cam 674, a cam contact member 675, and a coupling spring member 676.

The second roller supporting holder 673 includes a pair of second supporting plates 673P disposed to oppose each other with a clearance therebetween in the width direction (the front-rear direction). The tension roller 671 is supported between the pair of second supporting plates 673P. The pair of second supporting plates 673P is disposed outside the pair of first supporting plates 661P configuring the first roller supporting holder 661 and outside the first supporting roller 63 in the width direction. FIGS. 2 to 4 illustrate only one of the pair of second supporting plates 673P and do not illustrate the other second supporting plate.

The second roller supporting holder 673 is supported to the main body frame 61 so as to be rotationally movable about a rotationally moving shaft provided to extend through the pair of second supporting plates 673P. The rotationally moving shaft of the second roller supporting holder 673 is coaxial with the rotary shaft 631 of the first supporting roller 63.

The cam contact member 675 is a member with which the belt tension adjusting cam 674 comes in contact. The cam contact member 675 is supported to the main body frame 61 so as to be rotationally movable about a rotationally moving shaft 6753 disposed on a left side of the second roller supporting holder 673. The cam contact member 675 includes a plate-shaped cam contact portion 6751 extending in the width direction (the front-rear direction), and a pair of projected portions 6752 protruding downward from both the edges of the cam contact portion 6751 in the width direction. The cam contact portion 6751 is a portion with which the belt tension adjusting cam 674 makes contact. The rotationally moving shaft 6753 is provided to extend through the pair of projected portions 6752. Further, the pair of projected portions 6752 of the cam contact member 675 and the pair of second supporting plates 673P of the second roller supporting holder 673 are coupled by the coupling spring member 676. That is, the cam contact member 675 and the second roller supporting holder 673 are coupled by the coupling spring member 676.

The belt tension adjusting cam 674 is a cam member that is supported to the main body frame 61 so as to be rotatable about a cam rotary shaft 6741. The belt tension adjusting cam 674 is disposed at a center portion of the cam contact portion 6751 of the cam contact member 675 in the width direction (the front-rear direction) or a pair of the belt tension adjusting cams 674 is disposed on both sides in the width direction, respectively. The belt tension adjusting cam 674 rotates about the cam rotary shaft 6741 while making contact with the cam contact portion 6751 of the cam contact member 675. In the roller moving mechanism 672, the cam contact member 675 rotationally moves about the rotationally moving shaft 6753 in conjunction with the rotation of the belt tension adjusting cam 674. The rotational movement of the cam contact member 675 causes the second roller supporting holder 673, which is coupled with the cam contact member 675 via the coupling spring member 676, to rotationally move about a rotationally moving shaft 6731. The rotational movement of the second roller supporting holder 673 moves the tension roller 671 supported to the second roller supporting holder 673. Accordingly, the tension of the endless belt 62 changes.

<Guide Member>

The guide member 80 mounted to the curl straightening device 60 will be described below. The guide member 80 is a plate-shaped member that is disposed over the width direction (the front-rear direction) between the pair of first supporting plates 661P in the first roller supporting holder 661. The guide member 80 guides the sheet S, which is supplied to the endless belt 62 while being guided by the sheet guide piece 611, toward the nip portion NP.

The guide member 80 is held by a guide holding member 81. The guide holding member 81 is hung from the curl straightening roller 65 at a right end of the pair of first supporting plates 661P so that the guide member 80, which extends vertically in the up-down direction, opposes the sheet guide piece 611. Further, a slide member 82 is fixed to the guide holding member 81. The slide member 82 slides up and down while making contact with the cam rotary shaft 6641 in response to the rotational movement of the first roller supporting holder 661 in conjunction with the rotation of the nip width adjusting cam 664.

The guide holding member 81, which is hung from the curl straightening roller 65, moves up and down in response to the rotational movement of the first roller supporting holder 661 with the guide holding member 81 being kept in a vertical state. At this time, the slide member 82 slides up and down while making contact with the cam rotary shaft 6641, and thus the guide holding member 81 is kept in the vertical state when the first roller supporting holder 661 rotationally moves. This maintains a constant position and state of the guide member 80, which is held to the guide holding member 81, relative to the curl straightening roller 65. Accordingly, guide stability for the sheet S to the nip portion NP through the guide member 80 can be achieved, and the sheet S can be caused to preferably pass through the nip portion NP.

<Contact Member>

Figure 5:
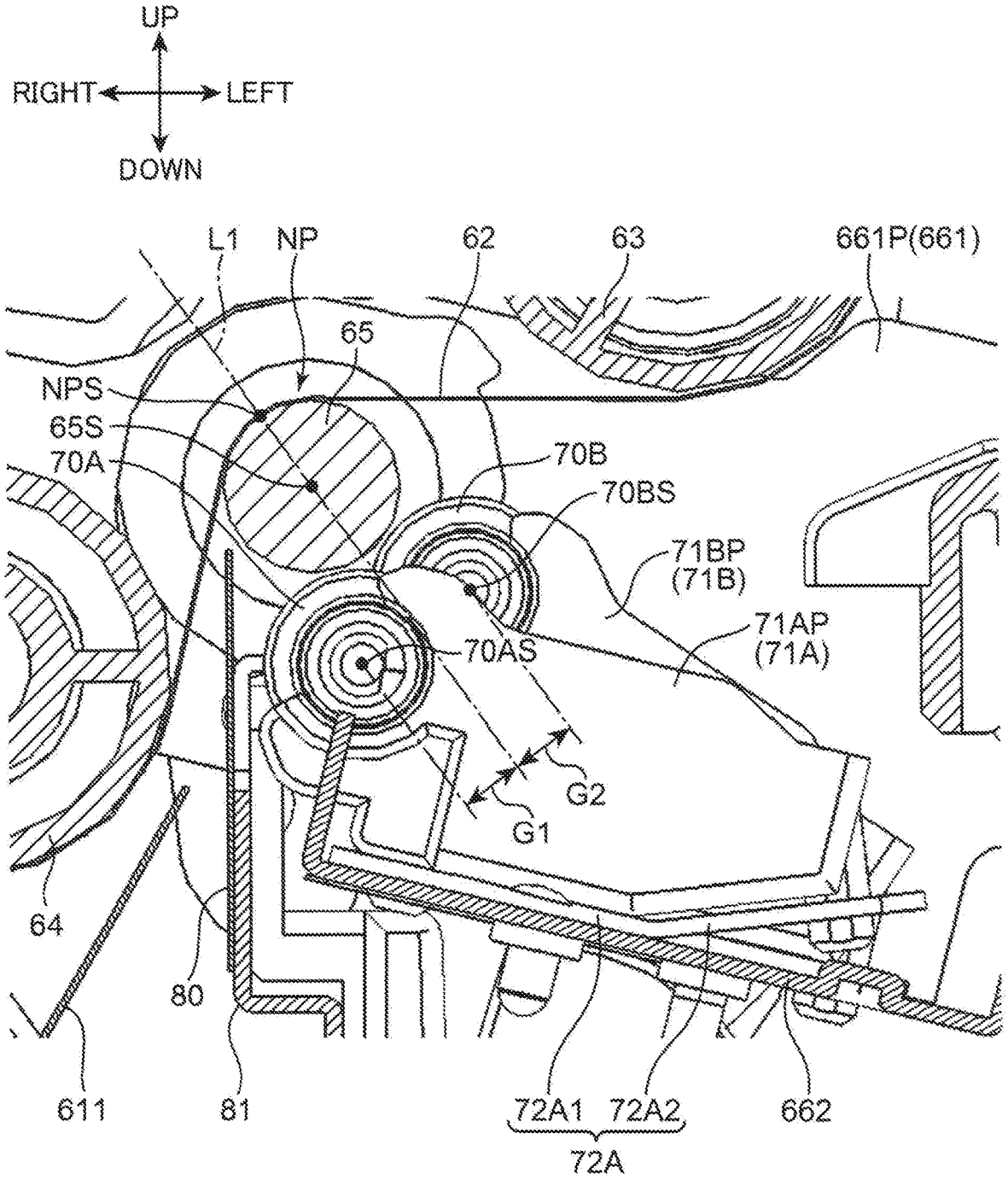
FIG. 5 is a cross-sectional view illustrating an enlarged vicinity of a contact member included in the curl straightening device.
Figure 6A:
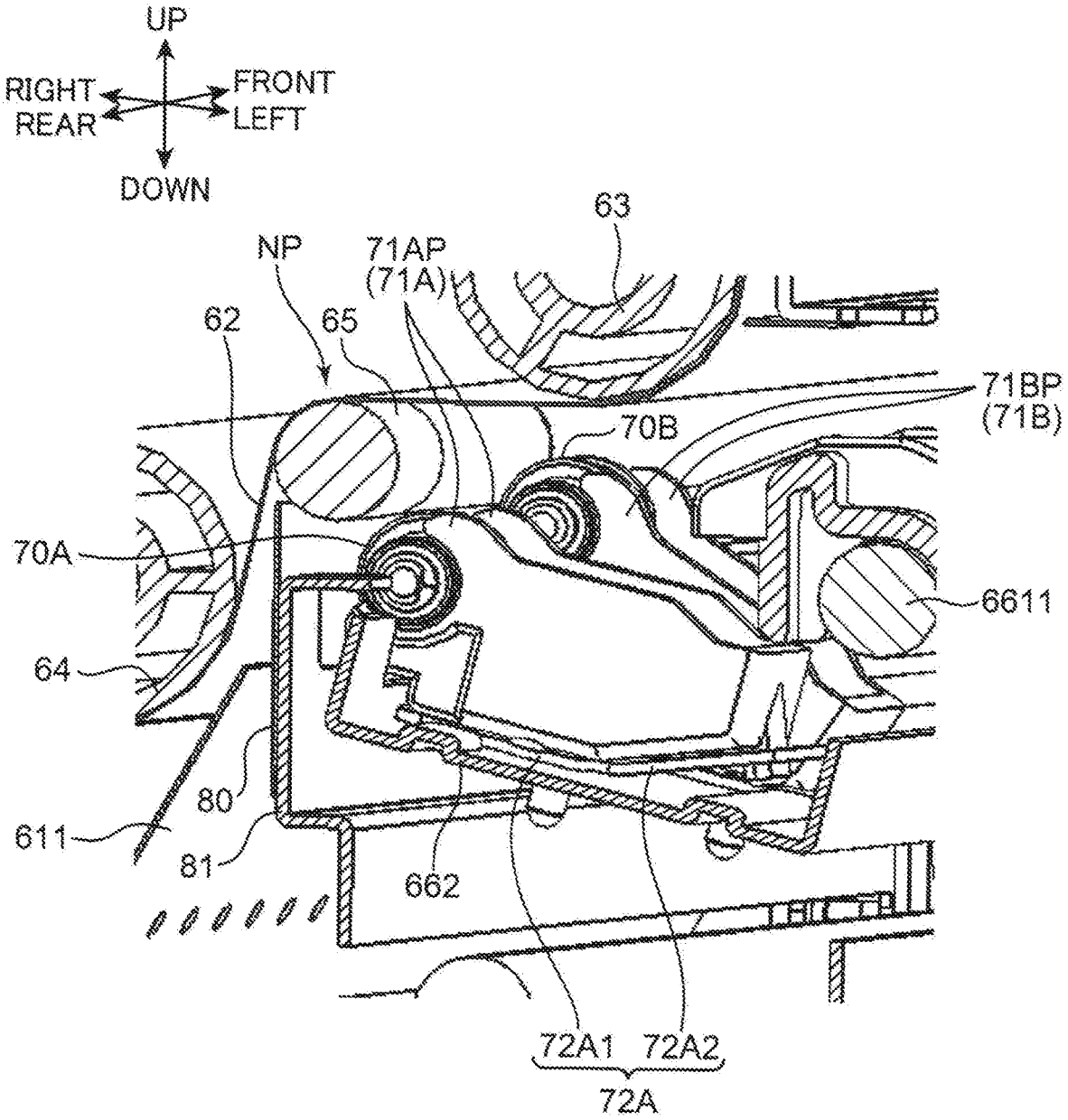
FIGS. 6A and 6B are perspective views illustrating mounting states of the contact member.
Figure 6B:
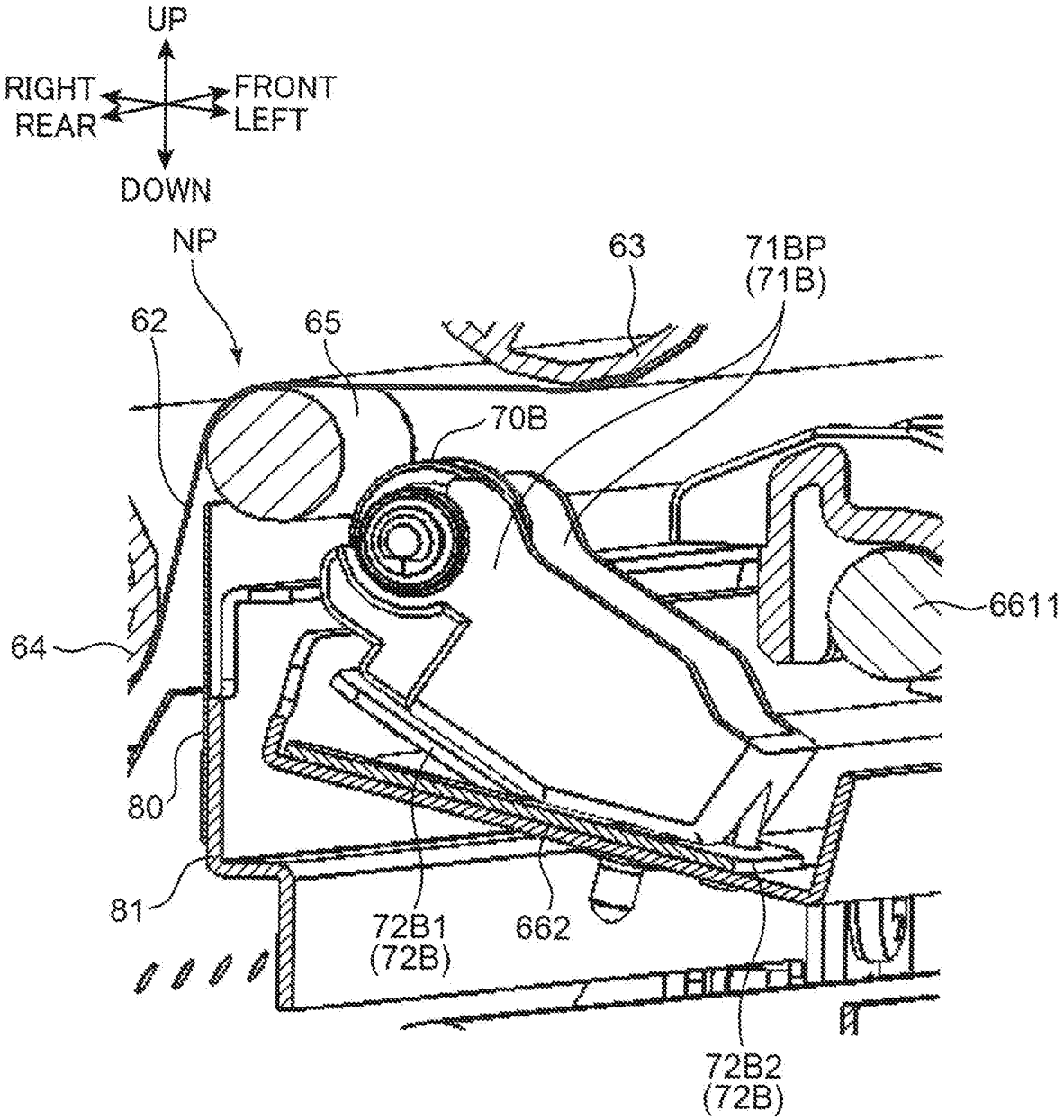

With reference to FIGS. 5, 6A, and 6B as well as FIGS. 2 to 4, the contact members 70A and 70B mounted to the curl straightening device 60 will be described below. FIG. 5 is a cross-sectional view illustrating an enlarged vicinity of the contact members 70A and 70B. FIG. 6A and FIG. 6B are perspective views illustrating mounting states of the contact members 70A and 70B.

The contact members 70A and 70B are disposed at the center portion of the curl straightening roller 65 in the axial direction so as to oppose each other on an opposite side of the curl straightening roller 65 from the nip portion NP. The contact members 70A and 70B make contact with the curl straightening roller 65 so as to prevent deformation of the curl straightening roller 65. In the present embodiment, the contact members 70A and 70B are rotary members that are driven to rotate by making contact with the curl straightening roller 65.

In the state in which the nip width adjusting mechanism 66 moves the curl straightening roller 65 so that the nip width in the nip portion NP is the second nip width wider than the first nip width as the reference (the state in FIG. 3), a high nip load is generated in the nip portion NP. If such a high nip load deforms the center portion of the curl straightening roller 65 in the axial direction toward a direction away from the endless belt 62 (a direction opposite to the nip portion NP), the contact members 70A and 70B, which are the rotary members, make contact with the curl straightening roller 65 and are driven to rotate. Such an action can prevent the curl straightening roller 65 from being excessively deformed, thus preventing occurrence of "wrinkle" on the sheet S which passes through the nip portion NP and reducing variations of the curl straightening force for the sheet S in the axial direction of the curl straightening roller 65. For this reason, curl of the sheet S can be straightened appropriately. Further, the contact members 70A and 70B, which are the rotary members, make contact with the curl straightening roller 65 and driven to rotate, thus reducing generation of high friction between the contact members 70A and 70B and the curl straightening roller 65 as much as possible.

In the embodiment, the plurality of contact members 70A and 70B is disposed side by side in the axial direction (the front-rear direction) of the curl straightening roller 65. Specifically, the two contact members 70A and 70B are disposed. Hereinafter, the contact member on the rear side is referred to as the "first contact member 70A", and the contact member on the front side as the "second contact member 70B". The first contact member 70A and the second contact member 70B are separated from each other in the peripheral and axial directions of the curl straightening roller 65. The first contact member 70A is supported by a first supporting member 71A so as to be drivenly rotatable, and the second contact member 70B by a second supporting member 71B so as to be drivenly rotatable. The first supporting member 71A and the second supporting member 71B partially configure the first roller supporting holder 661, and are mounted to the bottom plate 662 of the first roller supporting holder 661 independently from each other.

The first supporting member 71A and the second supporting member 71B partially configure the first roller supporting holder 661, and are mounted to the bottom plate 662, thus being movable together with the curl straightening roller 65 in response to the rotational movement of the first roller supporting holder 661 about the rotationally moving shaft 6611. As a result, the first contact member 70A supported to the first supporting member 71A and the second contact member 70B mounted to the second supporting member 71B are constantly kept in their positions relative to the curl straightening roller 65. For this reason, if the curl straightening roller 65 is deformed, the first and second contact members 70A and 70B make contact with the curl straightening roller 65 and are driven to rotate, thus preventing the curl straightening roller 65 from being excessively deformed.

The first supporting member 71A includes a pair of first supporting plates 71AP disposed to oppose each other with a clearance therebetween in the width direction, and a first mounting portion 72A connected to lower ends of the pair of first supporting plates 71AP (see FIG. 6A). The pair of first supporting plates 71AP, which has a plate shape extending to a left side opposite to the nip portion NP from the curl straightening roller 65, supports the first contact member 70A rotatably at the upper right ends of the pair of first supporting plates 71AP. The first mounting portion 72A, which extends on the left side opposite to the nip portion NP from the curl straightening roller 65, is mounted to the bottom plate 662 of the first supporting member 71A. Similarly, the second supporting member 71B includes a pair of second supporting plates 71BP disposed to oppose each other with a clearance therebetween in the width direction, and a second mounting portion 72B connected to the lower ends of the pair of second supporting plates 71BP (see FIG. 6B). The pair of second supporting plates 71BP, which has a plate shape extending on the left side opposite to the nip portion NP from the curl straightening roller 65, supports the second contact member 70B rotatably at the upper right ends of the pair of second supporting plates 71BP. The second mounting portion 72B, which extends on the left side opposite to the nip portion NP from the curl straightening roller 65, is mounted to the bottom plate 662 of the second supporting member 71B.

The first mounting portion 72A has a bent shape having a first mounting surface 72A1 and a second mounting surface 72A2 which extends toward the left side from the first mounting surface 72A1. In the first mounting portion 72A, the second mounting surface 72A2 tilts toward a direction crossing the axial direction of the curl straightening roller 65 at a predetermined angle relative to the first mounting surface 72A1. Similarly, the second mounting portion 72B has a bent shape having a first mounting surface 72B1 and a second mounting surface 72B2 which extends toward the left side from the first mounting surface 72B1. In the second mounting portion 72B, the second mounting surface 72B2 tilts toward a direction crossing the axial direction of the curl straightening roller 65 at a predetermined angle relative to the first mounting surface 72B1.

The first supporting member 71A is fixed to the bottom plate 662 via the first mounting surface 72A1 with the second mounting surface 72A2 being bent upward. On the other hand, the second supporting member 71B is fixed to the bottom plate 662 via the second mounting surface 72B2 with the first mounting surface 72B1 being bent upward. In such a configuration, the first contact member 70A supported by the first supporting member 71A and the second contact member 70B supported by the second supporting member 71B are disposed in the peripheral direction of the curl straightening roller 65 so as to be separated from each other.

Specifically, in the state in which the curl straightening roller 65 is disposed so that the nip width in the nip portion NP is the second nip width wider than the first nip width as the reference (the state in FIG. 3), the first contact member 70A and the second contact member 70B are disposed on symmetrical positions relative to a virtual line L1 passing through a midpoint NPS of the nip portion NP and an axis center 65S of the curl straightening roller 65, as seen from the axial direction of the curl straightening roller 65 as illustrated in FIG. 5. As for more details, the first contact member 70A and the second contact member 70B are disposed with them being separate from each other in the peripheral direction of the curl straightening roller 65 so that a distance G1 from an axis center 70AS of the first contact member 70A to the virtual line L1 is equal to a distance G2 from an axis center 70BS of the second contact member 70B to the virtual line L1. In such a configuration, if the nip load in the nip portion NP deforms the center portion of the curl straightening roller 65 in the axial direction toward the direction away from the endless belt 62, both the first contact member 70A and the second contact member 70B make contact with the curl straightening roller 65 and are driven to rotate. Such driven rotation can reduce occurrence of excessive deformation on the curl straightening roller 65 in the state in which the curl straightening roller 65 is disposed so that the nip width is the second nip width wider than the first nip width.

Further, the first contact member 70A and the second contact member 70B each are configured so that a predetermined clearance (for example, 0.3 mm) is formed between them and the curl straightening roller 65. When the curl straightening roller 65 is deformed, the first contact member 70A and the second contact member 70B make contact with the curl straightening roller 65 and thus are driven to rotate. The predetermined clearances are formed between the first contact member 70A and the curl straightening roller 65 and between the second contact member 70B and the curl straightening roller 65, respectively, thereby reducing deformation, caused by the contact forces of the first and second contact members 70A and 70B, of the curl straightening roller 65 toward the nip portion NP.

The above has described the embodiment of the present disclosure, but the present disclosure is not limited to the embodiment and thus includes various modifications.

The above embodiment has described the ink-jet recording apparatus as the image forming apparatus 1, but the image forming apparatus 1 of the present disclosure is not limited to the ink-jet recording apparatus. The image forming apparatus 1 of the present disclosure includes any image forming (recording) apparatuses having the curl straightening device 60 for straightening curl of the sheet S where an image has been formed, such as a laser beam image forming apparatus, a thermal image forming apparatus, and a wire dot image forming apparatus other than the ink jet image forming apparatus.

Further, the above embodiment has described an example in which the contact members 70A and 70B are rotary members that are driven to rotate by making contact with the curl straightening roller 65. The contact members 70A and 70B may be any non-rotary members which can make use of the capability of preventing deformation of the curl straightening roller 65.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A curl straightening device that straightens curl of a sheet to be conveyed, the curl straightening device comprising:

supporting rollers disposed rotatably about shafts extending in a direction orthogonal to a conveying direction of the sheet;

an endless belt that is stretched across the supporting rollers and circulates in the conveying direction;

a curl straightening roller that makes pressure contact with an outer peripheral surface of the endless belt between the supporting rollers so as to form a nip portion, and straightens curl of the sheet which passes through the nip portion, the nip portion being shaped so that the endless belt curves along a peripheral surface of the curl straightening roller; and a contact member that is disposed to oppose a center portion of the curl straightening roller in an axial direction and makes contact with the curl straightening roller so as to prevent deformation of the curl straightening roller, wherein the contact member includes a first rotary member and a second rotary member that make contact with the curl straightening roller and thus are driven to rotate, and the first rotary member and the second rotary member are disposed with clearances therebetween in peripheral and axial directions of the curl straightening roller, respectively.

2. The curl straightening device according to claim 1, further comprising: a nip width adjusting mechanism that moves the curl straightening roller to a direction away from or close to the endless belt so as to change a nip width in the nip portion in the conveying direction, wherein the nip width adjusting mechanism includes a roller supporting holder that is supported so as to be rotationally movable about a predetermined rotationally moving shaft so that the curl straightening roller rotationally moves to the direction away from or close to the endless belt, and a rotationally moving portion that rotationally moves the roller supporting holder about the rotationally moving shaft.

3. The curl straightening device according to claim 1, wherein the roller supporting holder includes a pair of supporting plates that is disposed to oppose each other with a predetermined clearance therebetween and supports the curl straightening roller rotatably, and a first supporting member that rotatably supports the first rotary member and, a second supporting member that rotatably supports the second rotary member.

4. The curl straightening device according to claim 3, wherein the roller supporting holder includes a bottom plate that is disposed between the pair of supporting plates and extends along the axial direction of the curl straightening roller, the first supporting member and the second supporting member are disposed along the axial direction of the curl straightening roller, the first supporting member and the second supporting member each includes a mounting portion which is mounted to the bottom plate, the mounting portion includes a first mounting surface and a second mounting surface which tilts at a predetermined angle relative to the first mounting surface, and one of the first supporting member and second supporting member is fixed to the bottom plate via the first mounting surface, and the other supporting member is fixed to the bottom plate via the second mounting surface.

5. The curl straightening device according to claim 1, wherein the first rotary member has a predetermined clearance between the first rotary member and the curl straightening roller, and the second rotary member has a predetermined clearance between the second rotary member and the curl straightening roller, and when the curl straightening roller is deformed, the first rotary member and second rotary member each makes contact with the curl straightening roller to be driven to rotate.

6. The curl straightening device according to claim 1, wherein the first rotary member and the second rotary member are disposed on symmetrical positions relative to a virtual line passing through a midpoint of the nip portion and an axis center of the curl straightening roller as seen from the axial direction of the curl straightening roller.

7. An image forming apparatus, comprising:

an image forming unit that forms an image on a sheet; and the curl straightening device according to claim 1 that straightens curl of the sheet where an image has been formed by the image forming unit.

8. A curl straightening device that straightens curl of a sheet to be conveyed, the curl straightening device comprising:

supporting rollers disposed rotatably about shafts extending in a direction orthogonal to a conveying direction of the sheet;

an endless belt that is stretched across the supporting rollers and circulates in the conveying direction;

a curl straightening roller that makes pressure contact with an outer peripheral surface of the endless belt between the supporting rollers so as to form a nip portion, and straightens curl of the sheet which passes through the nip portion, the nip portion being shaped so that the endless belt curves along a peripheral surface of the curl straightening roller; and a contact member that is disposed to oppose a center portion of the curl straightening roller in an axial direction and makes contact with the curl straightening roller so as to prevent deformation of the curl straightening roller, wherein the contact member has a predetermined clearance between the contact member and the curl straightening roller, and when the curl straightening roller is deformed, the contact member makes contact with the curl straightening roller.

* * * * *